United States Patent [19]

Marx, Jr.

[11] Patent Number: 4,885,059

[45] Date of Patent: Dec. 5, 1989

[54] EDGE CURLING DEVICE FOR FOURDRINIER FABRIC

[76] Inventor: Edmund N. Marx, Jr., 102 E. Weed St., St. Marys, Ga. 31558

[21] Appl. No.: 223,617

[22] Filed: Jul. 25, 1988

[51] Int. Cl.[4] ..... D21F 1/24

[52] U.S. Cl. ..... 162/274; 162/341; 162/354; 198/826

[58] Field of Search ..... 162/351-354, 162/272, 273, 274, 348, 199; 210/400, 401, 541; 198/825, 826

[56] References Cited

U.S. PATENT DOCUMENTS

| | | | |
|---|---|---|---|
| 203,825 | 5/1878 | Healy | 198/825 |
| 490,850 | 1/1893 | Johnston | 198/825 |
| 1,772,484 | 8/1930 | Hayward | 162/354 |
| 3,138,240 | 6/1964 | Michaelson | 198/826 |
| 3,294,218 | 12/1966 | Chartland | 198/826 |
| 3,928,124 | 12/1975 | Hansen | 162/354 |
| 4,738,751 | 4/1988 | Newcombe | 162/354 |

FOREIGN PATENT DOCUMENTS

| | | | |
|---|---|---|---|
| 1171570 | 1/1959 | France | 198/826 |
| 1244066 | 7/1986 | U.S.S.R. | 198/826 |

*Primary Examiner*—Karen Hastings

*Attorney, Agent, or Firm*—Arthur G. Yeager; Earl L. Tyner

[57] ABSTRACT

A roller device attachable to the frame of a Fourdrinier paper-making machine near the lateral edges of the forming fabric in the sheet forming zone to press against each of the lateral edges of the forming fabric and cause them to curl upwardly so as to contain the fibrous slurry on the forming fabric.

19 Claims, 6 Drawing Sheets

EDGE CURLING DEVICE FOR FOURDRINIER FABRIC

BACKGROUND OF THE INVENTION

The weakest and roughest portion of a sheet of paper coming off the Fourdrinier paper-making machine has always been the extreme lateral edges of the sheet (a strip approximately 12" to 24" wide). Frequently, this strip is so poor in quality that they must be diverted to cheaper grades or culled completely. Many devices have been tried to improve the overall profile and quality of the sheet, but in general, the edges do not improve in quality along with improvements to the rest of the sheet. There is no known device that is exclusively directed to improving the edge of the sheet. The rotating device of the present invention will provide a tool to bring the quality of the edges of the sheet closer to the quality of the rest of the sheet. Not only will this improve the quality and strength of the sheet edge, it will greatly improve the runability of the sheet through the paper machine, thus resulting in less down time.

The Fourdrinier paper-making process involves a traveling endless screen or forming fabric onto which is fed an aqueous dispersion or slurry of fibers of cellulose or other materials. This aqueous dispersion is fed onto the fabric from a headbox at a rate or velocity substantially equal to the speed of the fabric (plus or minus 20%). While this aqueous slurry is in its most liquid state before the dewatering devices begin removing the water, the slurry will tend to run to and off the sides of the moving forming fabric. This invention will curl or lift the edge of the fabric to stop this flow over the edges.

There have been several attempts to solve this problem; many are in use today but all have serious drawbacks. The devices in use today are all stationary "curlers" made from plastic materials. Typical of such is U.S. Pat. No. 3,928,124 to Hansen. Although these devices do curl the edge of the fabric, their stationary design causes friction on the moving fabric and causes serious edge wear and considerably shortens the life of the forming fabric. Papermakes have a real need to employ edge curling devices but they cannot afford to damage the expensive forming fabric. The present invention will give the papermaker a device which will curl or lift the edge of the forming fabric with a rotating tool so as to contain the slurry on the edge without damage to the fabric. With this frictionless tool, the papermaker can do things with the fabric that he would not dare do with stationary devices.

It is an object of this invention to provide a novel papermaking device to contain the slurry on the edges of the moving forming fabric. It is another object of this invention to provide a unique device to lift or change the plane of travel of the fabric and, therefore, rearrange the slurry and improve the edge of the sheet on the Fourdrinier forming fabric. Still other objects will become apparent from the more detailed description which follows.

BRIEF SUMMARY OF THE INVENTION

This invention relates to an edge curling device for use with a forming screen of a Fourdrinier papermaking machine. The device includes a freely rotating roller symmetrical about its axis and mounted on a shaft wherein the axis of the shaft and the rotational axis of the roller coincide. The shaft is adjustably attachable to an articulated bracket rigidly attached to the frame of the machine. The articulated bracket is arranged and adapted to press the roller against a lateral edge of the screen to cause the edge to curl upwards as it passes across the roller. The articulated bracket is designed so that the roller may be disposed at any angle of contact and positioned along the screen.

In specific embodiments of the invention the roller contains a bearing to which the shaft is connected, the shaft extending out one end only of the roller; the roller may be in any of several simple designs symmetrical about the rotational axis, including cylinders, cones, ellipsoids, and the like; and the roller may have a surface which is smoothed, grooved, or otherwise textured.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
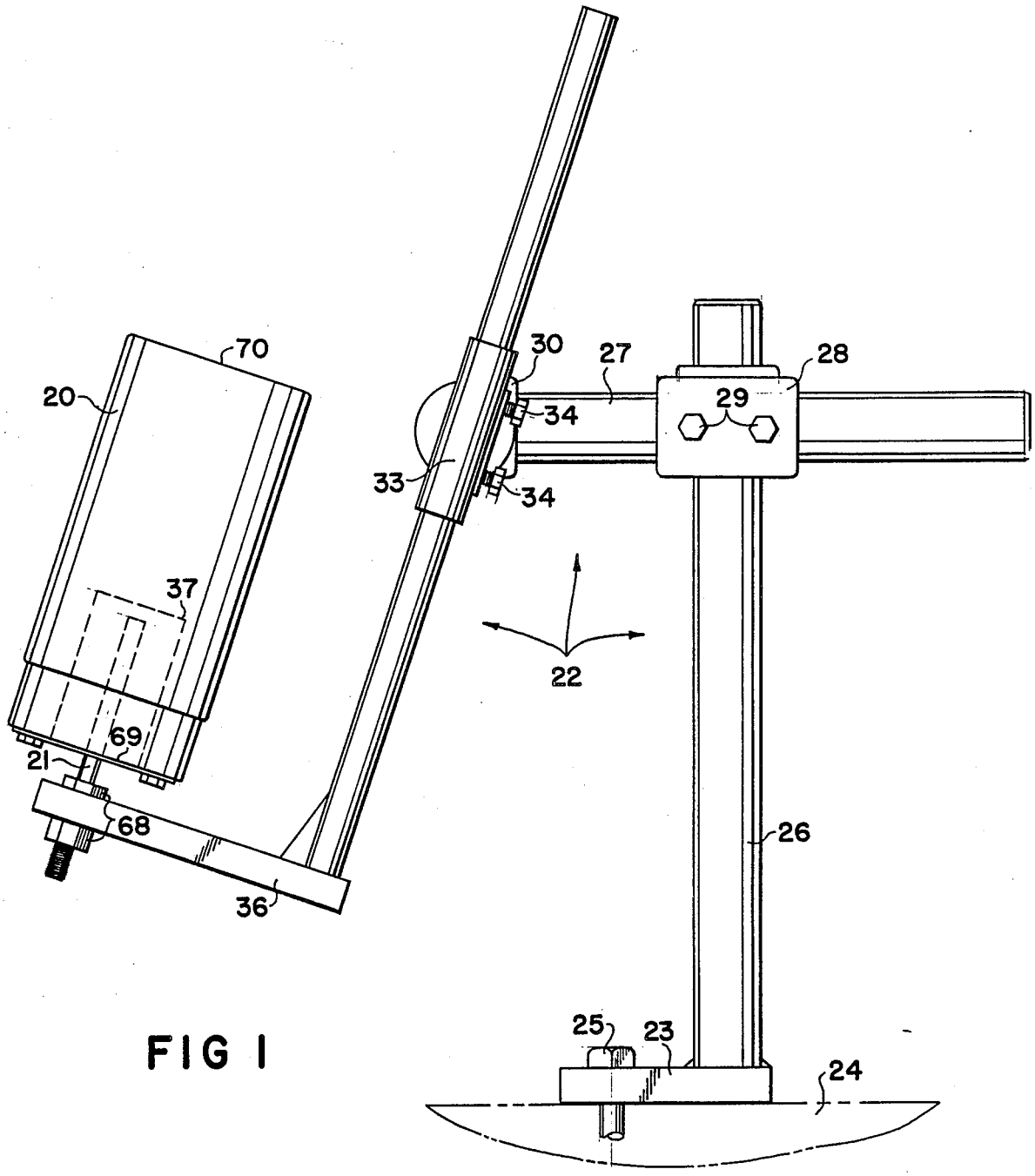
FIG. 1 is a front elevational view of the edge curling device of this invention.
Figure 2:
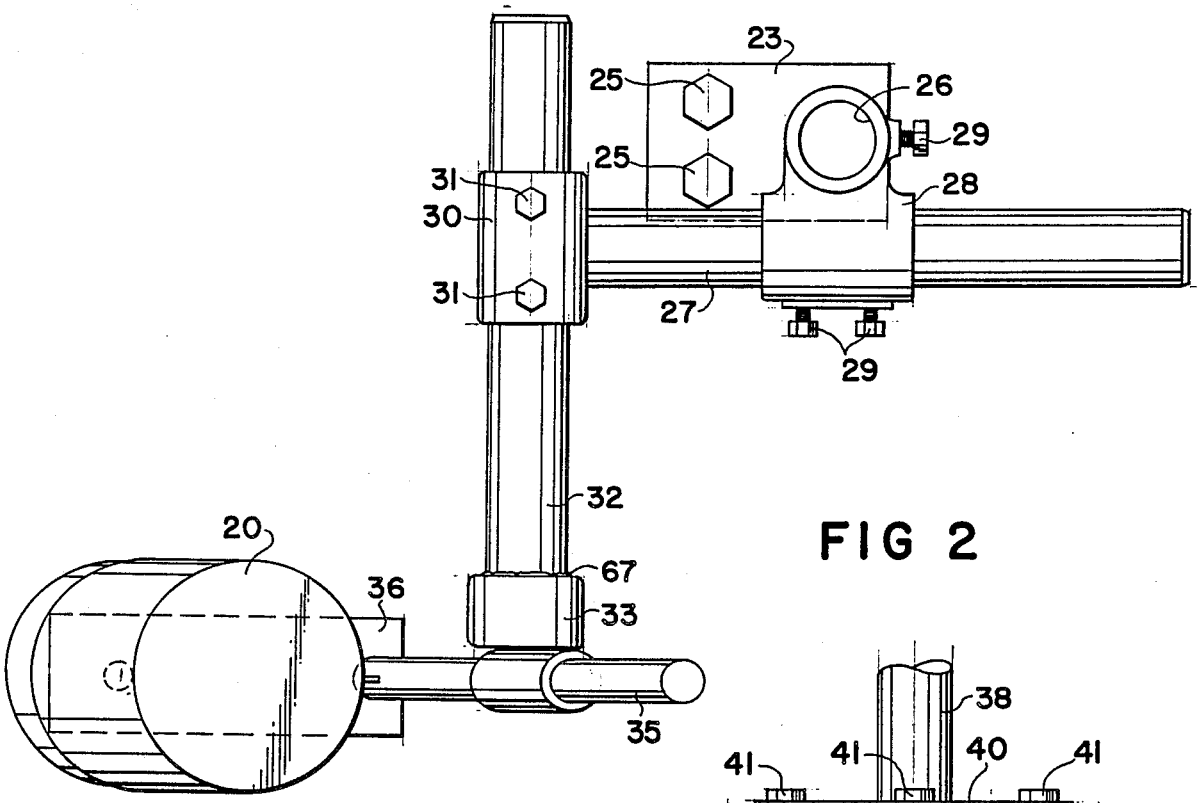
FIG. 2 is a top plan view of the edge curling device illustrated in FIG. 1.

The general features of the device of this invention are shown in FIGS. 1 and 2. A roller or spindle 20 is mounted on a shaft 21 which penetrates one (and preferably not both) end of roller 20 to engage an internal bearing 37, preferably a roller or ball bearing, which permits free rotation of the roller 20 about the shaft 21. Roller 20 is supported by an articulated bracket 22 having a plurality of arms and joints so as to permit the adjustment of roller 20 to any angle or position bearing against a lateral edge of a Fourdrinier forming fabric. In the design shown in FIGS. 1 and 2 there are three arms 26, 27, and 32 positioned generally at right angles to each other. The joints connecting one arm to another are tee fittings 28, 30 and 33. Tee 28 is a double sleeve receiving arm 26 in one sleeve and arm 27 in the other sleeve, both sleeves having set screws 29 to clamp arms 26 and 27 in any position while maintaining the two arms perpendicular to each other. Tee 30 permits arm 32 likewise to slide linearly and axially rotate therethrough until clamped in one position by tightening set screws 31. Arm 32 always is perpendicular to arm 27.

Support rod 35 is similarly attached to the end of arm 32 through tee 33, which may be welded rigidly to arm 32 or be clampable by set screws. In FIG. 2 tee 33 is shown to be welded at 67 to make a rigid connection to arm 32. Support rod 35 has a lateral foot 36 to which shaft 21 is affixed by nuts 68. Rod 33 is clamped by set screws 34. This type of rod is designed to permit roller 20 to be mounted with its free end 70 facing upwardly and its shaft end 69 facing downwardly. The advantage of such an arrangement is that water from the forming fabric will not run directly onto the bearing 37, but hopefully will mostly drain off the sides of roller 20 with a minimum of damage to bearing 37.

It may be seen that by twisting, lengthening, and shortening arms 26, 27, 32 and 33 through tees 28, 30 and 33, roller 20 may be positioned in any location and oriented in any direction, and held in such a selected position by tightening set screws 29, 31 and 34.

Figure 3:
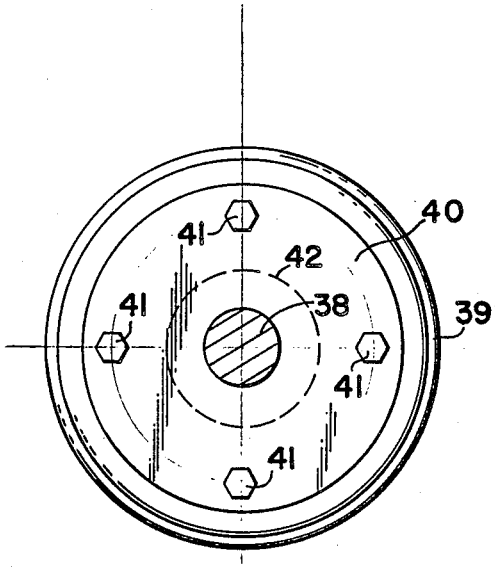
FIG. 3 is a top plan view of a first alternate design of the edge curling roller of this invention.
Figure 4:
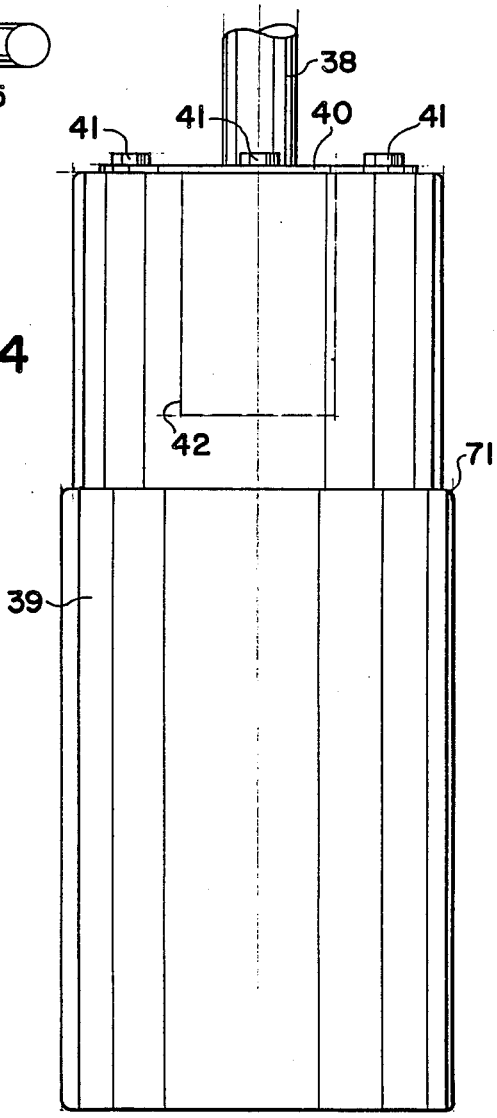
FIG. 4 is a front elevational view of the roller illustrated in FIG. 3.
Figure 6:
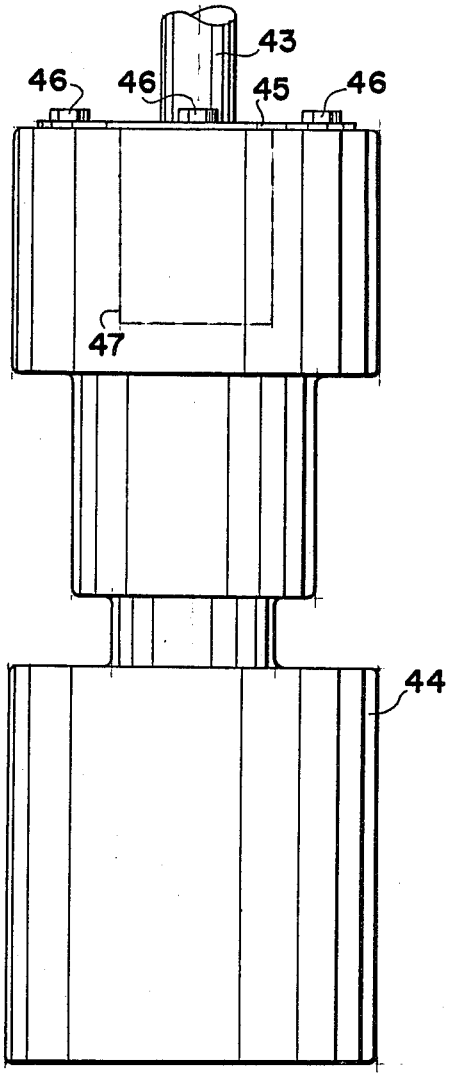
FIG. 6 is a front elevational view of the roller illustrated in FIG. 5.

FIGS. 3–6 show two alternate designs for the roller 20 of FIGS. 1 and 2. In FIGS. 3 and 4 roller 39 is a simple right cylinder with or without a stepped down diameter as at 71. Shaft 38 is attached to internal bearing 42 and the top opening of the bearing 38 is covered with a plate 41 held in place with belts or screws 41. There may also be lubrication fittings (not shown) through plate 41 for purposes of lubricating bearing 42. The design in FIGS. 5 and 6 involves a roller 44 with four cylindrical sections of different diameters, to reduce the weight of roller 44. Another weight reduction measure is to hollow out the lower portion of roller 39 or 44. A shaft 43, a bearing 47, a plate 45, and bolts or screws 46 are similar to the corresponding components of FIGS. 3 and 4.

Still other designs of rollers are useful. For example the roller may be of almost any outer contour which is smooth and is symmetrical about the rotational axis. Shapes that are wholly or partially cylindrical, conical, concave profiles, convex profiles, and the like are all operable. Furthermore, the surfaces of the roller may be smooth, textured, grooved, knurled, or the like. The materials of construction may be wood, metal, plastic, rubber, or other materials. Whatever is suitable to curl the edge of the forming fabric with a minimum of wear to the fabric and the roller may be used.

Figure 7:
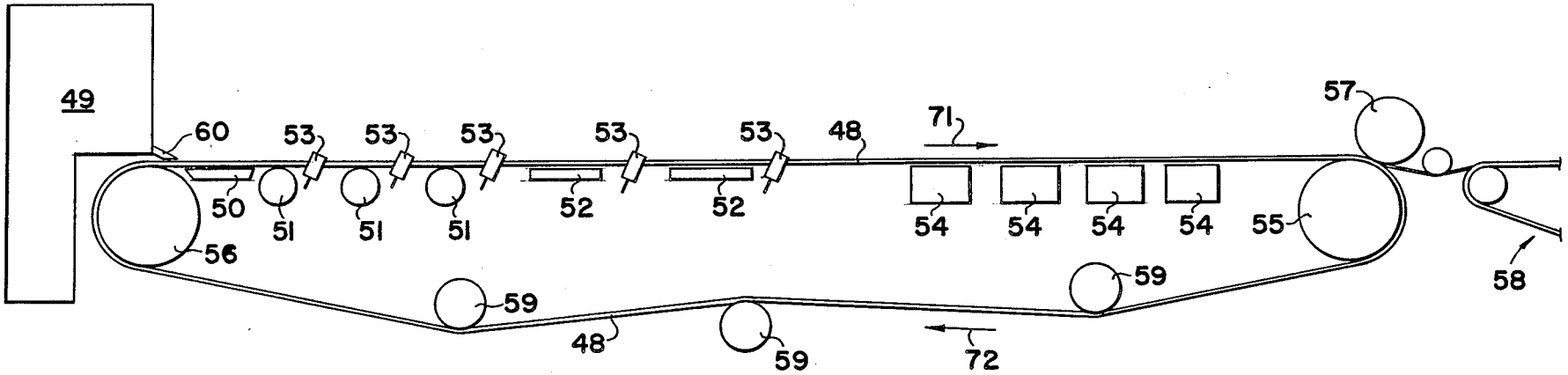
FIG. 7 is a schematic illustration of a typical Fourdrinier papermaking machine employing the edge curling rollers of this invention.

In FIG. 7 there is shown a schematic illustration of where the edge curling devices of this invention are placed in a Fourdrinier papermaking machine. An endless forming fabric or screen 48 moves in a clockwise direction as shown by arrows 71 and 72 around breast roll 56 and couch roll 55. Headbox 49 contains an aqueous slurry of papermaking fibers which is flowed onto fabric 48 at 60. Fabric 48 and its fiber slurry passes over forming table 50 where the fibers begin to settle into a thin layer which passes over table rolls 51, foils 52 and dewatering boxes 54 to produce a wet paper sheet that passes under lump breaker roll 57 and is stripped off to be finished in press section 58. The forming fabric 48 which passes couch roll 55 is returned via return rolls 59 to breast roll 56 and made ready to receive aqueous slurry at 60 again.

In the space between forming table 50 and the last foil 52 forming fabric is a moving flat screen with a fluid aqueous slurry on its top surface, and as expected, it is very difficult to contain the slurry on the lateral edges of the fabric 48. In the past practice the edges of the paper sheet being formed on fabric 48 have been uneven, inconsistent in thickness and quality, and generally unacceptable as a commercial product. Consequently, the edges have been trimmed and recycled into the process. Those edges (1–2 feet wide) have been an expense. In the present invention the fabric 48 is curled upwards by a plurality of devices 53 which permits a much greater proportion of the paper sheet to be formed into a quality product and much less of the edge material to be waste for recycle.

Figure 8:
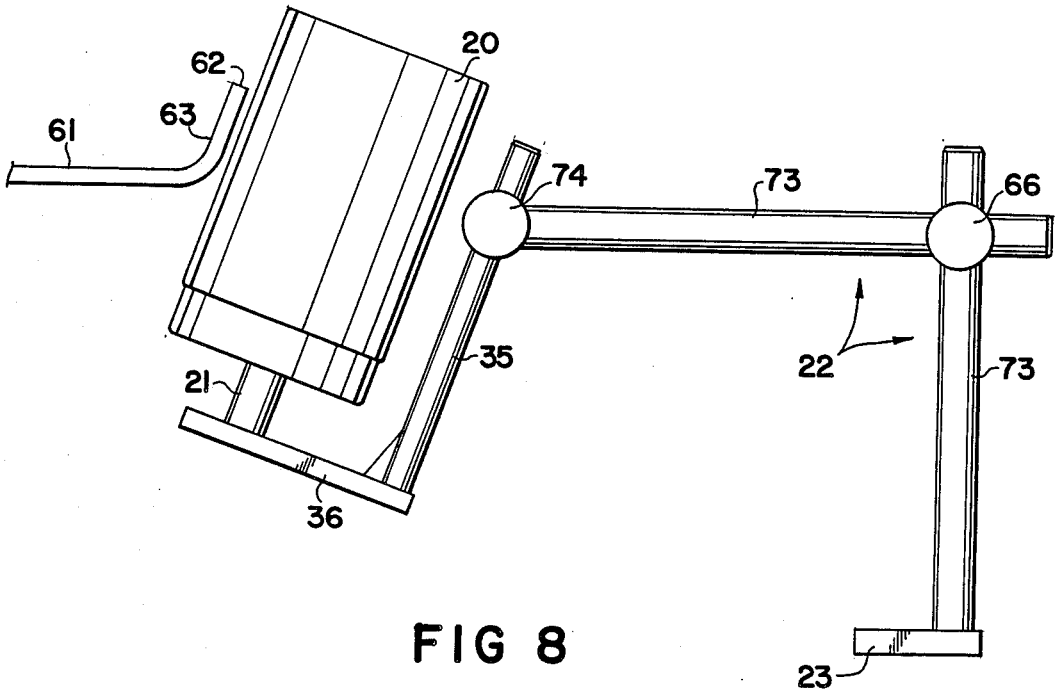
FIG. 8 is a schematic illustration showing how one embodiment of tis invention is used to curl the edge of a forming fabric.
Figure 9:
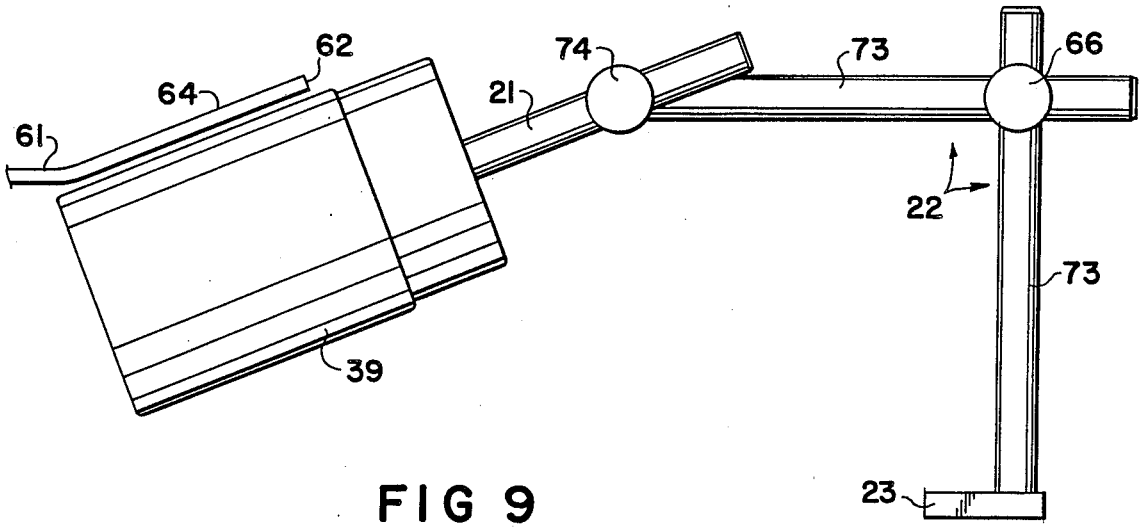
FIG. 9 is a schematic illustration showing how a second embodiment of this invention is used to curl the edge of a forming fabric.
Figure 10:
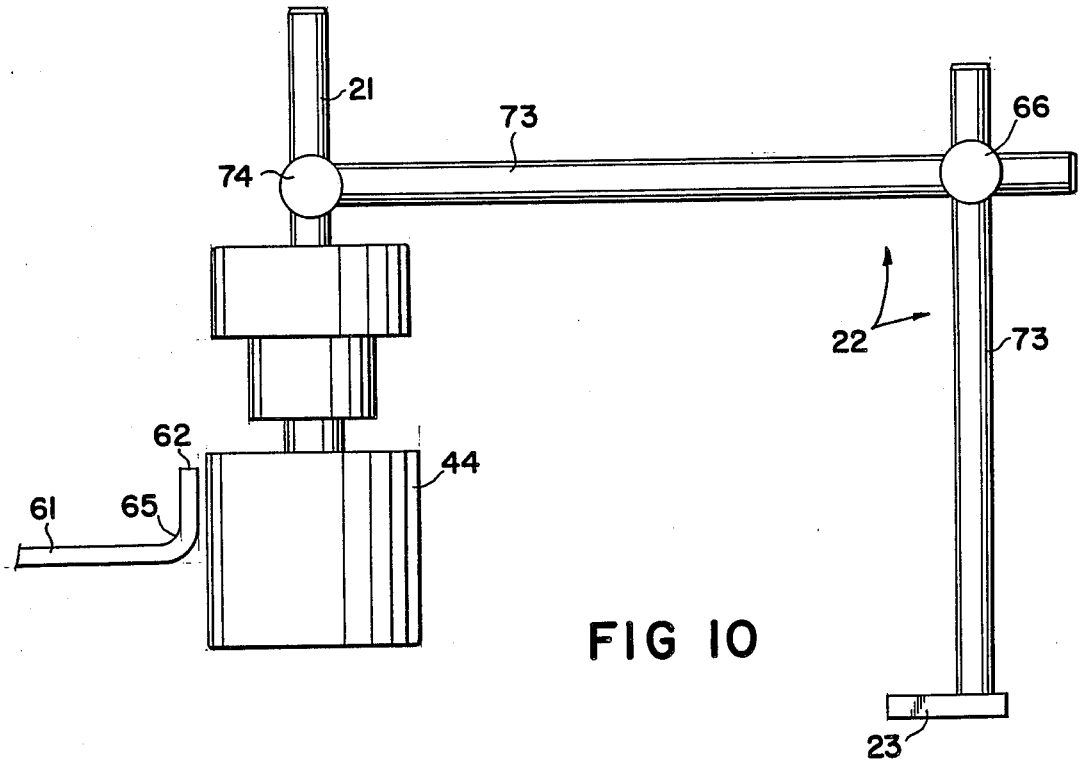
FIG. 10 is a schematic illustration showing how a third embodiment of this invention is used to curl the edge of a forming fabric.

In FIGS. 8–10 there are shown three embodiments of the edge curling devices of this invention and how they may be used to cure upwards the edge of the forming fabric 48. In FIG. 8 there is an arrangement similar to that shown in FIGS. 1–2 wherein the articulated bracket 22 has a foot 23 which is clampable to the frame of the Fourdrinier machine at any selected location along the lateral edges of the forming fabric 61 (same as 48 in FIG. 7). Roller 20 is held by support foot 36 and arm 35 which can be moved around to any position by manipulating the arms 73 of bracket 22 through the tee joints 66 and 74. Shaft 21 supports roller 20 through an internal bearing (not shown). Roller 20 presses against the lateral edge 62 of fabric 61 to press edge 62 upward forming a bent portion 63 in the fabric 61. This obviously will prevent any liquid on fabric 61 from running off the edge 62.

In FIG. 9 there is a second embodiment of the edge curling device in which roller 39 is held outwardly from bracket 22 by placing arms 73 and tee joints 66 in the desired position. Forming fabric 61 is pushed upwardly to produce a curled portion 64 with the lateral edge 62 high enough in elevation to prevent any undue spillage over edge 62. In this arrangement shaft 21 is affixed to its tee joint 74 and a holding bracket such as that of arm 35 and foot 36 in FIG. 8 is not needed.

In FIG. 10 still another arrangement of bracket 22 involving arms 73 and tee joints 66 and 74 permits roller 44 and shaft 21 to be positioned with its rotating axis substantially vertical. Roller 44 presses against forming fabric 61 near its lateral edge 62 to cause it to curl upwards, with curled portion 65 substantially vertical.

Other arrangements of bracket 22 and other rollers can be readily imagined to produce similar results of curling edge 62 upwards. The use of the holding bracket of arm 35 and foot 36 is an advantage where it is considered important to try to protect the bearing in the roller from too much contact with water and fiber. In the arrangement in FIG. 8 the bearing is at the bottom of roller 20 and will be somewhat protected from the slurry which will run downwards and drop off the sides of roller 20. In contrast, the arrangement in FIG. 9 would subject the bearing to the slurry if it overflowed at edge 62.

Figure 11:
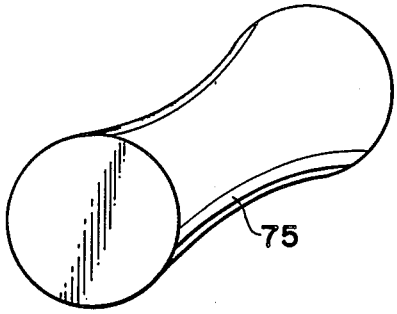
FIG. 11 is a perspective view of one design of the roller of this invention.
Figure 13:
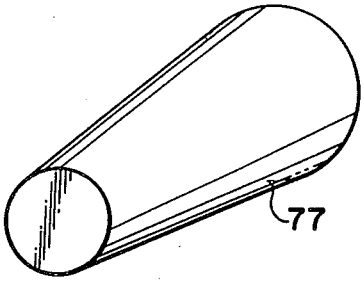
FIG. 13 is a perspective view of a third design of the roller of this invention.
Figure 5:
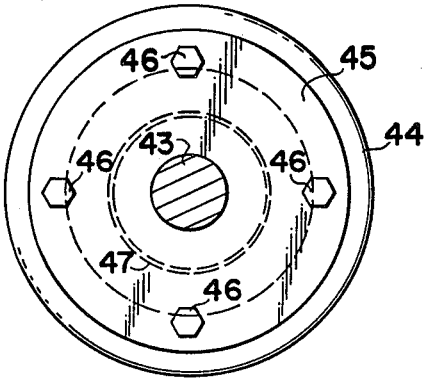
FIG. 5 is a top plan view of a second alternate design of the edge curling roller of this invention.
Figure 12:
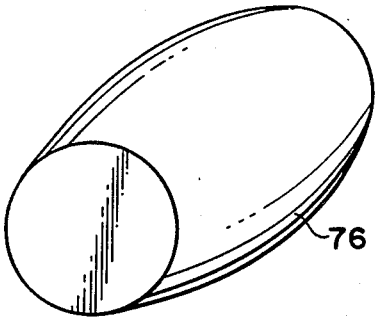
FIG. 12 is a perspective view of a second design of the roller of this invention.
Figure 14:
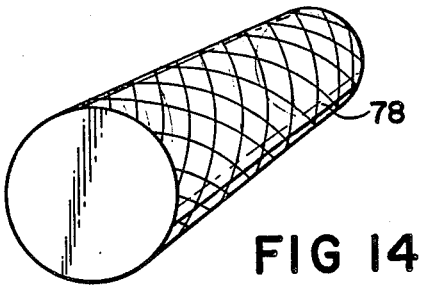
FIG. 14 is a perspective view of a fourth design of the roller of this invention.
Figure 15:
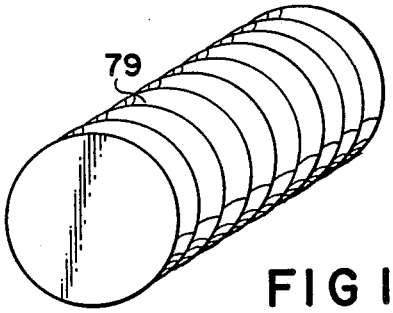
FIG. 15 is a perspective view of a fifth design of the roller of this invention.
Figure 16:
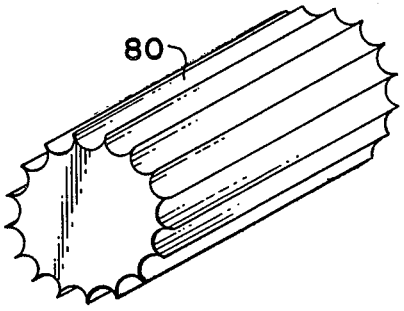
FIG. 16 is a perspective view of a sixth design of the roller of this invention.

In FIGS. 11–16 there are shown various designs for the roller (20 in FIG. 1) of this invention. In FIG. 11 the roller is concave 75 in that the diameter in the center is less than that at the two ends. In FIG. 12 the roller is convex 76 in that the diameter at the center is greater than that at the two ends. In FIG. 13 there is a conical shape 77 with a larger diameter at the bearing end than at the distal end. In FIG. 14 there is a conical shape 78 which is the reverse of that in FIG. 13, having the smaller diameter at the bearing end than at the distal end. Furthermore, the surface of the roller in FIG. 14 is textured or knurled. In FIGS. 15 and 16 are shown grooved surfaces on the roller. Grooves 79 are in the circumferential direction. Grooves 80 are in the lengthwise axial direction. Still other shapes and surface configurations can be employed within the scope of this invention.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a Fourdrinier papermaking machining having a travelling forming fabric with two lateral edges on a fixed machine frame, a plurality of spaced edge curling devices positioned along and in contact with the respective lateral edges of said forming fabric and structured to curl said lateral edges upwards; each said curling device comprising a generally cylindrical spindle symmetrical about its longitudinal axis mounted on a coaxial shaft with said spindle being freely rotatable about said axis, a mounting bracket for rigidly connecting said shaft to said frame, and an articulated adjustment means for positioning said spindle at any angle of contact and position with respect to said lateral edge, said articulate adjustment means including a plurality of shaft members joined to each other through a shaft connector means structured and arranged to permit axial rotational movement and sliding linear movement of each shaft member with respect to said shaft connector means.

2. The machine of claim 1 wherein said edge curling devices are mounted along said lateral edges in a sheet forming forward portion of said machine where said forming fabric has sufficient watery dispersion thereon to run over said lateral edges in the absence of a curled edge.

3. The machine of claim 1 wherein said spindle is mounted on said coaxial shaft with a rolling contact bearing joining said spindle to said shaft.

4. The machine of claim 3 wherein said spindle has a free unobstructed end and a shaft end into which said shaft is attached via said bearing.

5. The machine of claim 4 wherein said edge curling devices are mounted with said shaft end downwardly and said free end facing upwardly.

6. The machine of claim 4 wherein said edge curling devices are mounted with said shaft end facing upwardly and said free end facing downwardly.

7. The machine of claim 1 wherein said edge curling devices are employed in pairs with one of each pair on one lateral edge of said forming fabric and the other of each pair on the other lateral edge of said forming fabric, each said pair of said dvices generally being in lateral alignment.

8. The machine of claim 1 wherein said spindle is a right cylinder.

9. In a Fourdrinier papermaking machine, an edge curling device for use in curling upward the lateral edges of a forming screen of the Fourdrinier papermaking machine, said device comprising a freely rotating roller symmetrical about its axis and mounted on a shaft wherein the axis of the shaft and the rotational axis of said roller coincide, said shaft being adjustably attachable to an articulated bracket rigidly attached to the frame of a papermaking machine adjacent one of said lateral edges, said articulated bracket being structured to press said roller against said one lateral edge to cause it to curl upwards as it passes across said roller, said articulated bracket comprising a plurality of elongated arms and a fitting means structured and arranged to permit axial rotational movement and sliding linear movement of each arm with respect to said fitting means, said fitting means being clampable onto one of said arms in any desired position.

10. The device of claim 9 wherein said roller and said shaft are rotatably connected to each other by a bearing means located inside said roller.

11. The device of claim 9 wherein said roller is a right cylinder.

12. The device of claim 9 wherein said roller comprises a plurality of abutting cylindrical sections, having a common axis, each section having a different diameter than the next adjacent section.

13. The device of claim 9 wherein said roller has an arcuate profile when viewed perpendicularly to its axis.

14. The device of claim 9 wherein said roller has a smooth surface.

15. The device of claim 9 wherein said roller has a grooved surface.

16. The device of claim 10 wherein said shaft is connected to one end only of said roller with the other end of said roller being a smooth surfaced free end.

17. The device of claim 16 wherein said roller is positioned against the forming screen with its free end facing upwardly.

18. The device of claim 16 wherein said roller is positioned against the forming screen with its free end facing downwardly.

19. The device of claim 10, further comprising another fitting means connecting said shaft to one of said arms, said other fitting means being structured and arranged to permit axial rotational movement and sliding linear movement of said shaft with respect to said other fitting means.

* * * * *